US007994413B2

(12) United States Patent
Salo

(10) Patent No.: US 7,994,413 B2
(45) Date of Patent: Aug. 9, 2011

(54) ELECTROMAGNETIC PICKUP FOR STRINGED MUSICAL INSTRUMENT, AND AN ELECTRIC GUITAR

(76) Inventor: Jarno Johannes Salo, Mantsala (FI)

( * ) Notice: Subject to any disclaimer, the term of this patent is extended or adjusted under 35 U.S.C. 154(b) by 55 days.

(21) Appl. No.: 12/580,884

(22) Filed: Oct. 16, 2009

(65) Prior Publication Data

US 2010/0122623 A1 May 20, 2010

(30) Foreign Application Priority Data

Oct. 17, 2008 (FI) ..... 20085985

(51) Int. Cl.
*G10H 3/18* (2006.01)

(52) U.S. Cl. ..... 84/726; 84/728

(58) Field of Classification Search ..... 84/726–728
See application file for complete search history.

(56) References Cited

U.S. PATENT DOCUMENTS

| | | | |
|---|---|---|---|
| 2,896,491 | A | 7/1959 | Lover |
| 4,442,749 | A | 4/1984 | DiMarzio et al. |
| 4,524,667 | A | 6/1985 | Duncan |
| D319,456 | S | 8/1991 | Fender |
| 5,111,728 | A | 5/1992 | Blucher et al. |
| 5,530,199 | A | 6/1996 | Blucher |
| 5,668,520 | A | 9/1997 | Kinman |
| 6,291,759 | B1 | 9/2001 | Turner |
| 2002/0069749 | A1 | 6/2002 | Hoover et al. |

FOREIGN PATENT DOCUMENTS

| | | |
|---|---|---|
| GB | 2 364 594 | 1/2002 |

OTHER PUBLICATIONS

Finnish Search Report dated Sep. 7, 2009, from corresponding Finnish application.

*Primary Examiner* — Jeffrey Donels
*Assistant Examiner* — Andrew R Millikin
(74) *Attorney, Agent, or Firm* — Young & Thompson

(57) ABSTRACT

An electromagnetic pickup for a musical instrument, has two coils (2, 3) with pole pieces (4-8, 9-13) in their core regions and a connection that connects the two coils together, out of phase, in series or in parallel, so that they cancel each others extraneous noise and hum. To accomplish a noise-free pickup with the clarity and dynamics of a single coil pickup, and a uniform output level throughout its longitudinal axis, the coils are partly overlapping each other, the pole pieces in the core region of the first coil are partly overlapping with the pole pieces in the core region of the second coil, and the coils (2, 3) with the pole pieces (6-8, 1-13) induce the same voltage in the overlapping area (14) as the voltage induced by the coils and the pole pieces in their core regions outside the overlapping area (14).

19 Claims, 6 Drawing Sheets

ELECTROMAGNETIC PICKUP FOR STRINGED MUSICAL INSTRUMENT, AND AN ELECTRIC GUITAR

BACKGROUND OF THE INVENTION

This invention relates to a dual coil electromagnetic pickup assembly for stringed musical instrument, consisting of a first longitudinal structure, designed to support the first longitudinal coil, the said structure and coil having a first end and a second end, and a second longitudinal structure to support the second longitudinal coil, also having a first end and a second end. Both said coils consist of a magnetically permeable core region, and the said first coil has a magnetically permeable core region having the opposite polarity as opposed to the secondary coil. The coils are then connected in parallel or in series in such a way that they eliminate the extraneous noise or hum of each other.

The electromagnetic pickup described in the present invention serves particularly well as a pickup of an electric guitar, but can also be fitted to other musical instruments, such as a banjo etc.

Said dual coil electromagnetic pickups are well known to those working in the field. As opposed to single coil electromagnetic pickups, said dual coil pickups do not, or at least not notably, work as an antenna to pickup extraneous noise or hum. Therefore frequencies such as the 60 cycle hum generated by electronic equipment are not picked up and amplified to audible noise. These dual coil pickups are called humcancelling pickups or "humbuckers". Humbuckers consist of at least two coils connected out of phase to each other, so that the noise or the hum picked up by the two coils cancel one another out.

The original noise cancelling pickup design in the prior art was made by Lover and patented as U.S. Pat. No. 2,896,491. The disadvantage of the Lover side-by-side arrangement is that it senses the vibration of the string from a wider area in the string. This causes frequency loss and muted overall sound lacking clarity and detail. Humbuckers often lack the wide dynamic range of the single coil design.

It is known that there are musical instrument pickups that have two coils positioned end to end to each other, having opposite magnetic polarities and connected out of phase to each other. The first coil is placed under the strings so that it senses about half of the strings and the other coil is placed so that it senses the rest of the strings. The disadvantage of this design is that a "dead" area is created in the middle of the pickup. It is known that guitar players use a technique called string bending, where a string is pushed by the fingers to raise the frequency. By doing so, the string changes its position in relation to the pickup. If the string is bent so that it is positioned straight above the point where the ends of the coils meet and where the two magnetic fields meet, an extremely weak, out of phase signal is produced. Therefore the pickup of this design does not have a uniform output level throughout its length. The said problem does not appear in musical instruments the strings of which are usually not bent, such as an electric bass guitar.

Because the Lover design humbuckers have two coils positioned in a side by side manner, they are significantly wider in size compared to those that have only a single coil. If a pickup consisting of two side by side coils is to be installed on a guitar having routings and/or a pickguard made for a single coil sized pickup, significant changes to the instrument have to be made. These changes affect the value of the instrument in an undesirable way, especially if a vintage guitar is in question. One of the most popular electric guitar models is the Fender Stratocaster designed by Leo Fender, which has a three pickup design. It has remained almost unchanged to this day. The guitar model in question still consists of three single coil sized pickups. Therefore it still has the routings in the body cut to fit three single coil sized pickups. The pickups of these types of guitars have remained single coiled, because humcancelling pickups that would be of the same size and would not require major changes to the classic look of the guitar, and would have the same tonal balance, have not been possible yet.

Another well-known practice is to place two coils so that one coil senses about half of the instrument's strings and the other one senses the rest of the strings. The coils have a different axis and have been placed so that the coils and their core regions are far enough from each other, so that the magnetic fields do not interfere with each other (U.S. Pat. No. D319,456 issued to Fender). They also do not fit the existing routings and pickguard cut outs because of the two different longitudinal axes of the coils.

So the problem is how to make an electromagnetic pickup that would have the same clarity, dynamics and tonal balance as a single coil pickup, but would still have significantly less extraneous noise and hum.

One solution to make a humcancelling single-coil-sized pickup is to stack two coils on top of each other (U.S. Pat. No. 4,442,749 issued to Dimarzio et al.; U.S. Pat. No. 4,524,667 issued to Duncan; U.S. Pat. No. 5,668,520 issued to Kinman; U.S. Pat. No. 6,291,759 issued to Turner). But in order to fit the two coils on the guitar, the two coils together have to be approximately of the same height as that of the coil of a single coil pickup. Usually the uppermost coil of this type of pickup is the string vibration sensing coil and the lower coil's only function is to eliminate unwanted noise picked up by the uppermost coil. In other words, the lower coil is not designed to produce any audible sound. Since the uppermost coil in this design is only about half of the height of the entire coil in the single coil design, the sound produced by it differs from the sought after sound of a single coil. It is also preferable to have the two stacked coils magnetically isolated from each other to prevent an out of phase sound. This has been achieved by placing a U-shaped steel plate under the uppermost coil to direct the magnetic field. This plate also has its effect on the sound.

All known ways of making humcancelling single coil sized pickups have failed to produce the clear and dynamic sound of a single coil pickup or they have had an unbalanced output level throughout the length of the pickup.

SUMMARY OF THE INVENTION

It is an object of the present invention to provide an improved electromagnetic pickup for musical instruments that has significantly less extraneous noise and hum and still has all the characteristics of the sound of a single coil pickup and a uniform output level throughout its length. It is a second object of the present invention to provide two coils that together form approximately the same shape and size as that of the coil of a single coil pickup, and have the same type of magnetic field as that of a single coil pickup.

It is another object of the present invention to provide an electromagnetic humfree musical instrument pickup that is of the same size that has been the standard for many decades for many of the most popular guitar models.

To achieve the foregoing objects, the present invention has two coils partly in parallel to each other (henceforth: overlapping) approximately in the middle of the pickup, and has two magnetic fields overlapping each other approximately in the middle of the pickup, and has two coils with their core regions made of magnetically permeable material that in the area where they overlap together induce a voltage that is approximately the same as the voltage induced by the coils and magnetically permeable core regions outside the area where the two coils and magnetic fields overlap.

It is preferable to have the number of turns of the first end of the first coil to be fewer than the number of turns of the first coil outside the area where the coils are overlapping. It is also preferable to have the number of turns of the first end of the second coil to be fewer than the number of the turns of the second coil outside the area where the coils are overlapping. It is also preferable to have the number of turns of both coils to be uniform both in the area where the coils overlap and outside the area where coils overlap.

Preferably both of the coils consist of a core region of magnetically permeable material, which is placed in the area where the two coils overlap one another, and where they are also surrounded by 1000-5000 rounds of copper coil wire, and both coils also consist of a secondary core region made of magnetically permeable material, placed outside the area where the coils overlap one another and surrounded by 6000-12000 rounds of copper coil wire. Doing so creates a system in which the vibrating string of the instrument induces the same type of voltage in the area where the coils overlap as in the area of the pickup where the coils do not overlap. Using the said number of coil turns, a typical isolated copper wire with the thickness of 0.060-0.065 mm can be used.

The preferable ways of making the present invention are explained in the following claims 2-13.

The greatest benefits accomplished by the electromagnetic musical instrument pickup described in the present invention are: It has considerably less extraneous noise and hum, it has the same clarity and dynamics as a single coil pickup and induces a uniform voltage throughout the longitudinal axis of the pickup, independent of where the string is situated over the length of the pickup. Another great benefit of the pickup is that it fits the existing routings and pickguard cut outs and requires no alteration to the instrument.

The outstanding characteristics of an electric guitar of the present invention are presented in the following claim 14.

The preferred ways of making an electric guitar of the present invention are described in the following claims 15 and 16.

The benefits accomplished by the guitar of the present invention are the same as the benefits accomplished by the pickup of the present invention. The overall look of the guitar can be the look of any given guitar.

A BRIEF DESCRIPTION OF THE DRAWINGS

Further objects and advantages of the invention will become apparent from the following detailed description taken in conjunction with the accompanying figures in which:

FIG. 1 is a known single coil pickup viewed from the top with the cover on

FIG. 2 is a known single coil pickup viewed from the top without the cover and showing the placement of the coil and the magnetically permeable material FIG. 3 is a known Lover design humbucker viewed from the top showing the placement of the coil and the magnetically permeable material FIG. 4 is a preferred embodiment of the present invention viewed from the top, with the top cover plate on FIG. 5 shows the preferred placement of the magnetically permeable material and the coils of the pickup shown in FIG. 4.

DETAILED DESCRIPTION

Figure 1:
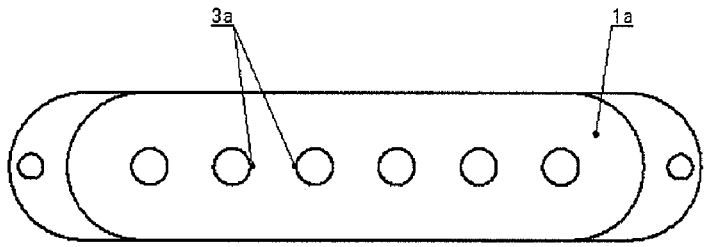
Fig. 1 PRIOR ART
Figure 2:
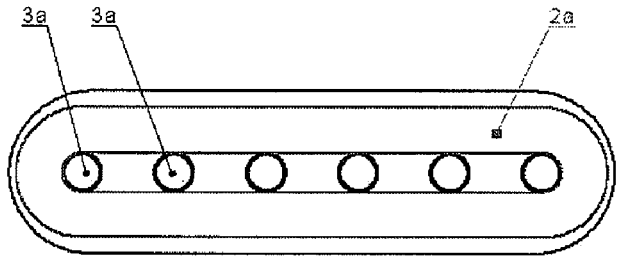
Fig. 2 PRIOR ART

FIGS. 1 and 2 illustrate a known single coil electromagnetic musical instrument pickup viewed from the top. The pickup includes a cover 1*a*, in which the longitudinal coil 2*a* is situated (shown in FIG. 2) and wrapped around a core region 3*a*. The core region is made from six preferably cylindrical shaped pole pieces 3*a*, made of magnetically permeable material. The top parts of the six pole pieces 3*a* that face the strings of the instrument are shown in FIGS. 1 and 2. The magnetic polarity of all six pole pieces 3*a* is the same; all six have their north pole facing the strings or all six have their south pole facing the strings. An appropriate gauge and amount of copper wire is wound over the core region 3*a* to form the coil 2*a*, as is known to those skilled in the art. The biggest disadvantage of a pickup illustrated in FIG. 1 is that it acts as a long antenna and picks up unwanted extraneous noise and hum.

Figure 3:
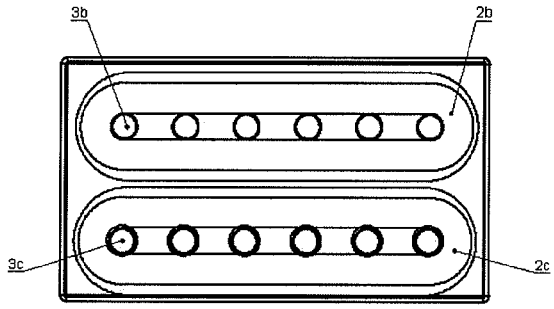
Fig. 3 PRIOR ART

FIG. 3 illustrates a known and typical humcancelling pickup design, well known to those skilled in the art, shown from the top. The coils 2*b* and 2*c* are wound in opposite directions, or wound in the same direction, but connected out of phase to each other, both coils having their core made of six magnetically permeable pole pieces 3*b* and 3*c*. All six pole pieces in the core 3*b* have their magnetic north pole facing the strings, and all six pole pieces in the core 3*c* have their magnetic south pole facing the strings. The coils of the pickup illustrated in FIG. 2*b* sense the vibration of the strings from a wider area, and thus the sound produced by the pickup lacks the clarity and detail of the pickup illustrated in FIG. 1. The width of the pickup in FIG. 2 is also double the width of the pickup in FIG. 1.

Figure 4:
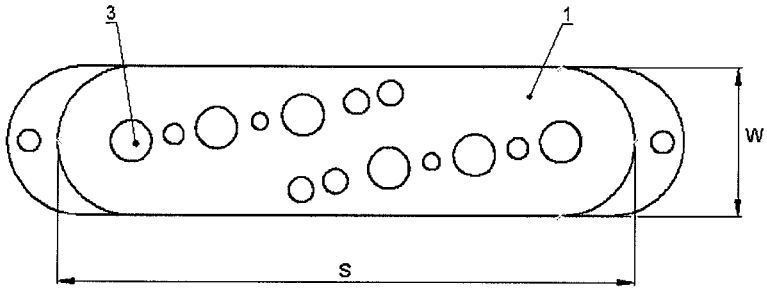
Figure 5:
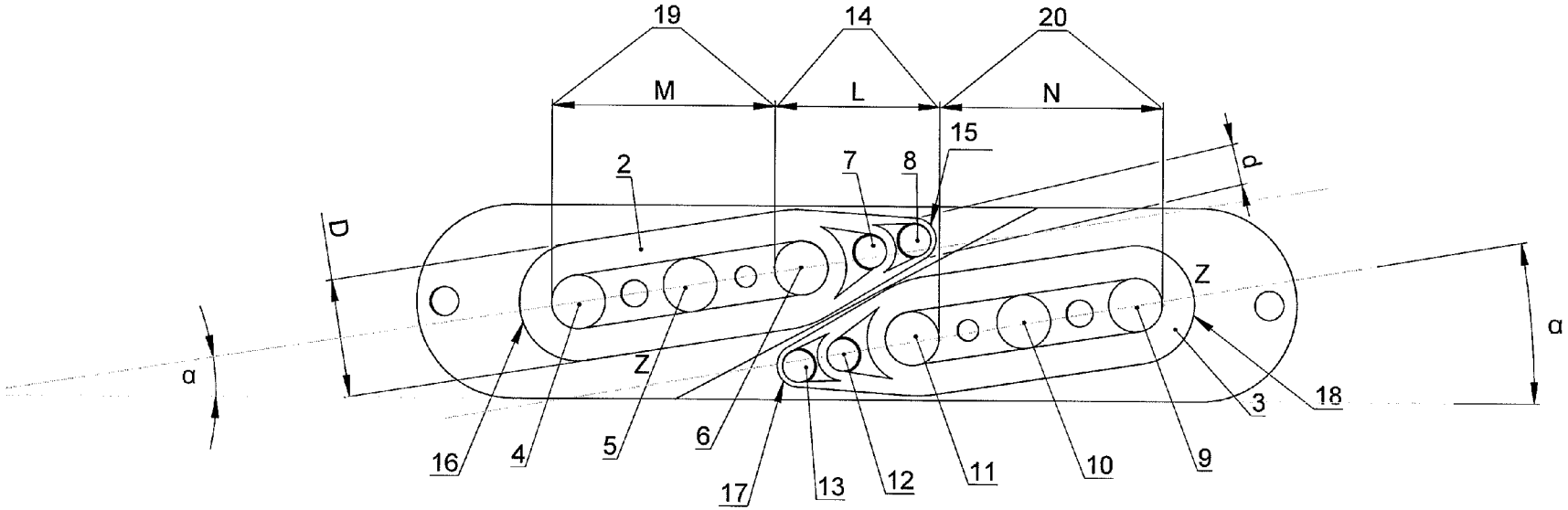

FIGS. 4 and 5 illustrate the electromagnetic musical instrument pickup of the present invention. The pickup consists of the top plate 1, under which two longitudinal coils (see FIG. 5) with their pole pieces 4-13 are situated. The coils 2 and 3 are soldered together, or placed on a longitudinal base plate 20. Coil 2 consists of a first end 15 and a second end 16 and coil 3 consists of a first end 17 and a second end 18. The coils 2 and 3 are out of phase to one another, that is, coil 2 is for instance wound clockwise and coil 3 counter clockwise, or both coils can be wound in the same direction, but connected out of phase to one another. Both coils 2, 3 have their core region made of five cylindrically shaped pole pieces 4-8 and 9-13 made of magnetically permeable material. Pole pieces 4-8 have their magnetic south pole facing up toward the strings and pole pieces 9-13 have their magnetic north pole facing up toward the strings. The polarity of the pole pieces in the core region of coil 2 has to be the opposite to the polarity of the pole pieces in the core region of coil 3. The pole pieces 4-13 are made of Alnico (AlNiCo) or other magnetically permeable material, which is known to be used in electromagnetic pickups for stringed musical instruments.

FIG. 5 shows that the coils 2, 3 are overlapping each other, and form an overlapping area 14, the length of the overlapping area being illustrated by the letter L. The pole pieces 7, 8, 12 and 13 are placed in the openings in the core region of the coil. The overlapping area 14 can be called area of a cumulative effect. The polarity of pole pieces 6-8 is the opposite compared to the polarity of pole pieces 11-13. In the overlapping area 14, the pole pieces 7, 8, 12 and 13 enable the pickup to induce a voltage when a string is vibrating over the overlapping area. The number of turns on the coils 2 and 3 and the strength of the magnetic field of the pole pieces in the overlapping area 14 are chosen so that, when in use, a voltage induced in the area where the coils and magnetic fields overlap one another is the same as the voltage induced outside the overlapping area, i.e. areas 19 and 20, which are situated on both sides of area 14. The length of area 19 is illustrated by the letter M and the length of area 20 is illustrated by the letter N. Thus, when the instrument is played and for instance the G string (not shown), which is situated over pole piece 11, is "bent" and moved over pole pieces 7 and 12, the pickup's coils 2 and 3 together induce a voltage that is the same as the voltage that is induced by coil 3 when the string vibrates over pole piece 11. It is thus possible for the pickup to induce a uniform voltage throughout the length of the pickup and no noticeable drop in the voltage level is present between pole pieces 6 and 11.

In order to keep the width of the pickup as small as possible, pole pieces 7, 8, 12 and 13, situated in the overlapping area 14, have a thickness smaller than the thickness of pole pieces 4-6 and 9-11. The thickness of the first mentioned pole pieces (7, 8, 12 and 13) is for instance 3 mm and the latter pole pieces (4-6 and 9-11) have a thickness of 5 mm. The pole pieces with the above mentioned thicknesses and the number of turns of coil wire wrapped around them together form the coils 2, 3 which are both decreasing in width in the overlapping area 14. Thus, the width (d) of the coils is significantly smaller in area 14, than the width (D) of the coils in areas 19 and 20.

The coils 2, 3 with their pole pieces 4-13 are at an angle •=15 degrees compared to the longitudinal axis of the pickup. When the longitudinal axis Z-Z of coil 3 is tilted to an angle • as compared to the longitudinal axis of the base plate 20 and seen as pointing to the left from the end of the pickup, and the longitudinal axis of coil 2 is tilted in the same manner as seen from the other end of the pickup and is pointing to the left, the sensitivity of the pickup on the overlapping area 14 is exceptionally good. Said angle • can be chosen to be smaller or larger than the given number. The preferred angle is 5-20 degrees.

When considering the balance and quality of the sound of the pickup, the best results are produced when 8500 turns of AWG 42 coil wire are wound on coil 2 around pole pieces 4-6, 3500 (2000+1500) turns of coil wire around pole piece 7 and 1500 turns of coil around pole piece 8. In practice, a winding like this is done in the following manner: The first 5000 rounds of coil wire are wound clockwise over pole pieces 4-6, pole piece 7 is added and 2000 more rounds of coil are wound over pole pieces 4-7, and then pole piece 8 is added and 1500 rounds of coil are wound over pole pieces 4-8. Coil 3 is wound with the same number of turns, only counter clockwise. When the coils are connected in series or in parallel, the coils cancel each other's extraneous noise and hum. In the overlapping area 14, the number of turns of coil matches roughly with the number of turns of coil in areas 19 and 20. The sound reproduction of the pickup can be altered by changing the number of turns over each of the pole pieces. By doing so, the string-to-string balance and/or tone of the pickup can be altered.

Figure 6:
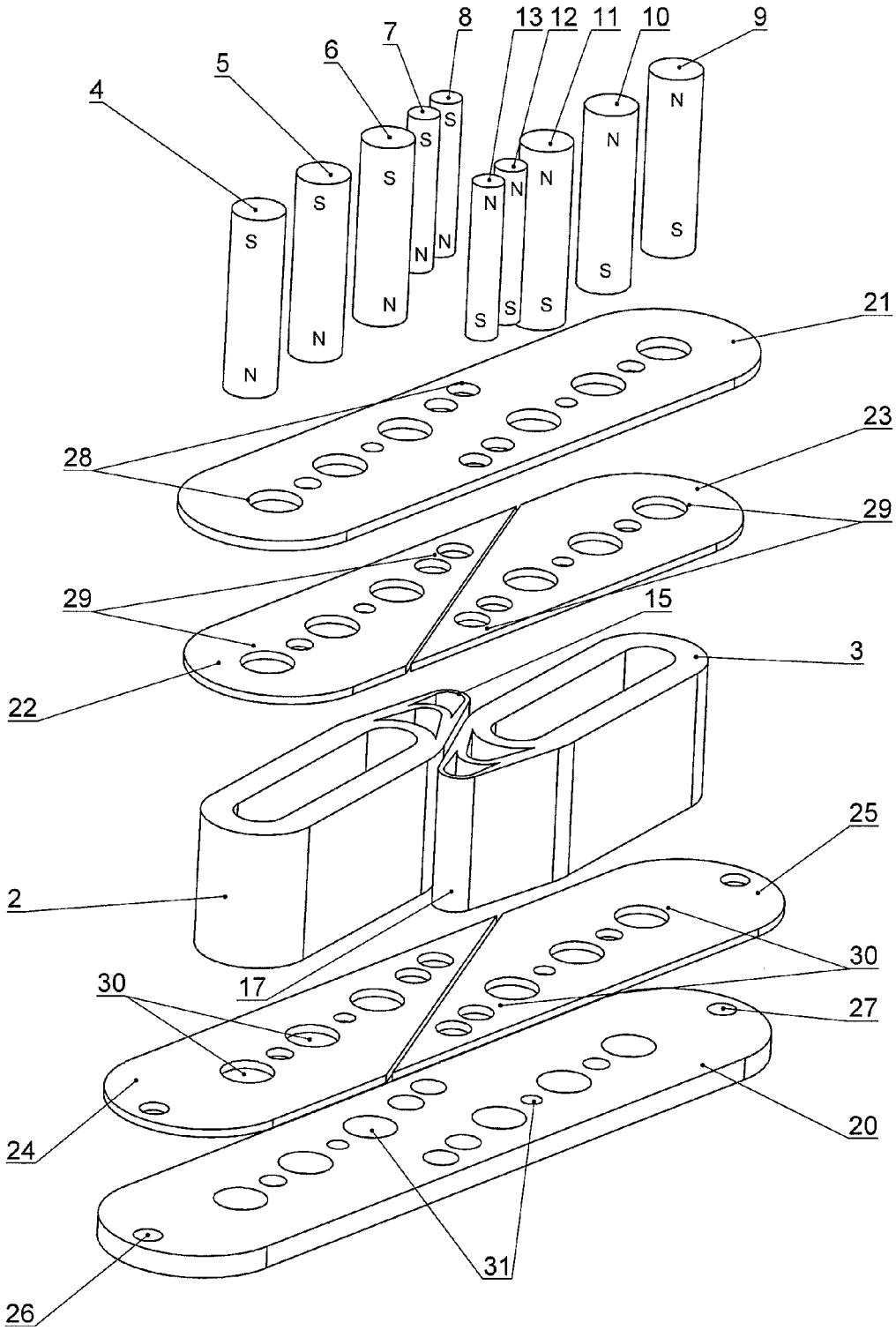
FIG. 6 is an exploded view of the pickup shown in FIG. 4

FIG. 6 shows an exploded view of the pickup of FIGS. 4 and 5. In FIG. 6, number 21 points to the top plate, made from nonmagnetic, nonconductive material. In the top plate 21 there are holes 28 for pole pieces 4-6 and 9-11.

Number 22 points to the top plate of coil 2, and number 23 to the top plate of coil 3. In top plates 22, 23 there are holes 29 for the pole pieces 4-13. The top plates are made from nonmagnetizable material and are either nonconductive or copper plated from one side.

Numbers 24 and 25 point to the bottom plates of the coils 2 and 3. The bottom plates 24 and 25 are made in the same manner as top plates 22, 23 and have holes 30 for the pole pieces 4-13.

Number 20 points to the base plate of the pickup. In the base plate 20 there are also holes for the pole pieces 4-13. The base plate 20 matches with plates 22-24 in terms of material and overall shape.

Numbers 26 and 27 point to the holes, which are used to fasten the pickup to a guitar or another instrument.

Figure 7:
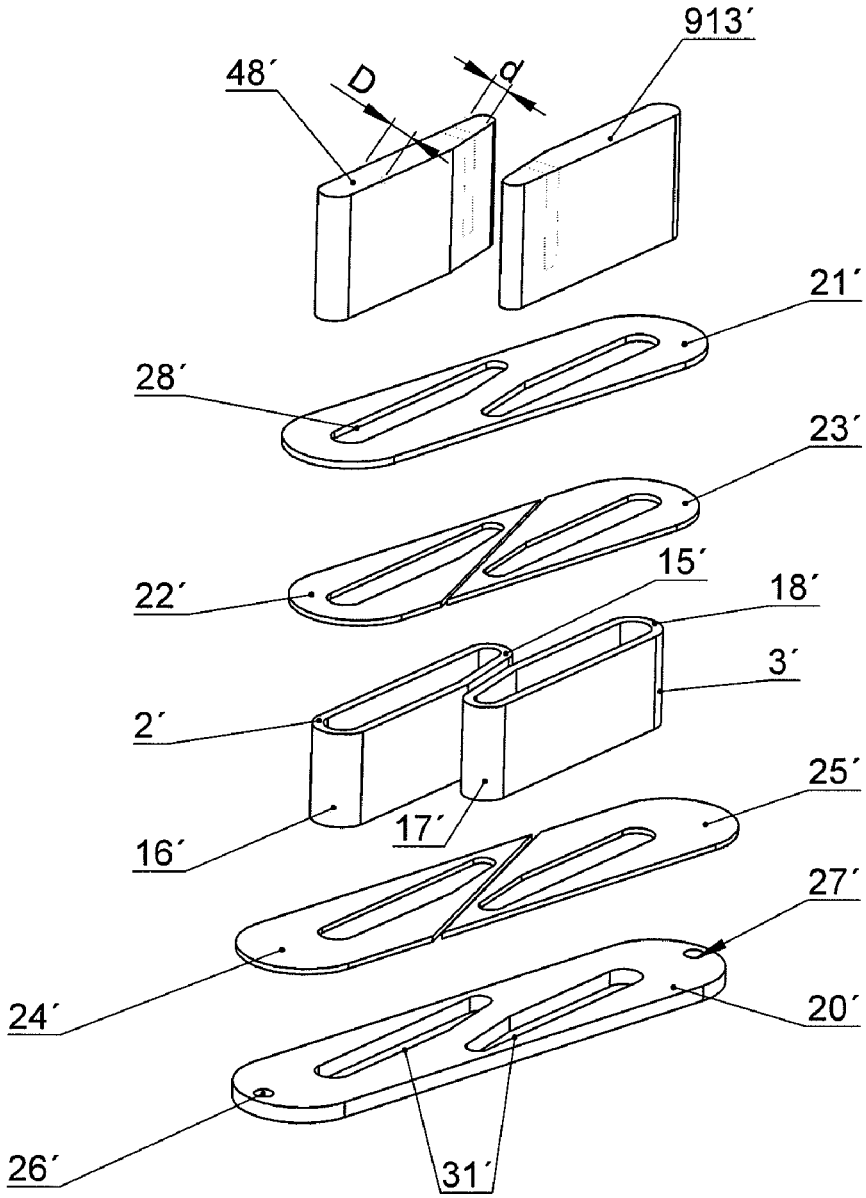
FIG. 7 is an exploded view of another possible structure of the present invention shown in FIG. 6
Figure 8:
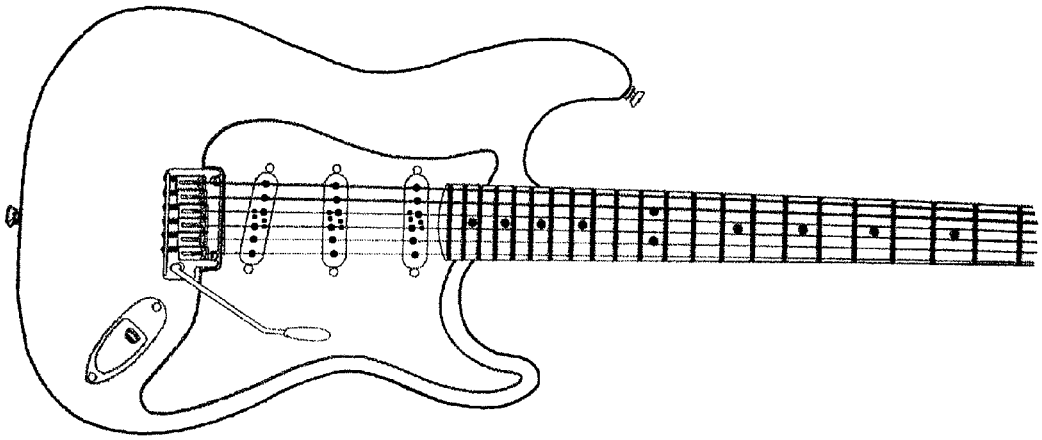
FIG. 8 shows a guitar described in the present invention with the pickups described in the present invention installed

FIG. 7 shows another alternative to FIG. 6. The same kind of numbering is used as in FIG. 6 for the matching components. The pickup in FIG. 7 differs from the one in FIG. 6 in the following manner: Pole pieces 4-8 and 9-11 in the coils 2', 3' are replaced by wedge-shaped pieces 48' and 913'. The pieces 48' and 913' are decreasing in width in the overlapping area (like area 14 in FIG. 5). When the coil wire is wound over the pieces 48' and 913', two coils are formed, their ends being of different width. The pieces 48' and 913' have a smaller width d in the overlapping area (like area 14 in FIG. 5) compared to the general width D (like areas 19 and 20 in FIG. 5) in the areas which are outside the overlapping area. The decreasing of the width of the coils 2' and 3' and the pieces 48' and 913' is necessary to keep the overall width in the overlapping area small enough. Decreasing the width of the pole pieces 48' and 913' is also necessary in order to keep the inductance level of the two coils together in the overlapping area at the same level as outside the overlapping area. The solution in FIG. 7 can be modified so that small pieces are cut from the wedge-shaped pieces illustrated by the dashed line, so that the same kind of coil structure as in FIG. 6 is achieved, where the coils 2' and 3' consist of fewer turns of coil in the overlapping area.

The present invention has been described in an illustrative manner. It is to be understood that the terminology which has been used is intended to be in the nature of words of description rather than limitation. Many modifications and variations of the present invention are possible in light of the above teachings. Therefore, the number of coils can be altered, the direction of the winding and the magnetic polarity of the pole pieces can be altered, the number and shape of the pole pieces can be altered and the number of turns of the coil wire can be altered. It is also possible to use ferrous material for the pole pieces and magnetize them by putting a magnet/magnets underneath the base plate.

The invention claimed is:

1. An electromagnetic pickup for a stringed musical instrument having a longitudinal first coil (2, 2') having a first end (15, 15') and a second end (16, 16') and a second longitudinal coil (3, 3') having a first end (17, 17') and a second end (18, 18'), both coils having a core region made of at least one permanent magnet or magnetically permeable material (4-8 and 9-13, 48' and 913'), and the said first coil core region (4-8, 48') has a magnetic polarity opposite to the said second coil core region (9-13, 913'), and a connection that connects the said two coils (2, 3, 2', 3') out of phase with one another, either in series or in parallel, so that any extraneous noise or hum is cancelled, characterized by the overlapping area (14) in which the two coils (2, 3, 2', 3') are partly overlapping each other and the core region (4-8, 48') of the said first coil (2, 2') is partly overlapping with the core region (9-13, 913') of the said second coil (3, 3'), and by that the coils (2, 2', 3, 3') having the core regions (4-13, 48', 913') are set to induce the same voltage in the overlapping area (14) that the coils (2, 2', 3, 3') induce outside the overlapping area (14).

2. An electromagnetic pickup of claim 1, wherein the first end (15) of the first coil (2, 2') has fewer turns of coil than the number of turns of coil in the area (19) that is outside the overlapping area (14).

3. An electromagnetic pickup of claim 2, wherein the first end (17) of the second coil (3, 3') has fewer turns of coil in the overlapping area (14) than the number of turns of coil in the area (20) that is outside the overlapping area (14).

4. An electromagnetic pickup of claim 3, wherein the said first coil (2, 2') and the said second coil (3, 3') have approximately the same number of turns in the overlapping area (14).

5. An electromagnetic pickup of claim 1, wherein the coils (2, 3, 2', 3') are decreasing in width in the overlapping area (14) and wherein the width (d) of the coils (2, 3, 2', 3') is generally smaller in the overlapping area (14) than the width (D) in the areas (19, 20) outside the overlapping area (14).

6. An electromagnetic pickup of claim 5, wherein the width (d) of the pole pieces in the core regions (4-13. 48, 913) of the coils (2, 2', 3, 3') is smaller in the overlapping area (14) than the width (D) outside the overlapping area (19, 20).

7. An electromagnetic pickup of claim 6, wherein both coils (2; 3) have a first core region (7, 8; 12, 13) in the overlapping area (14) and a secondary core region (4-6; 9-11) outside the overlapping area (14).

8. An electromagnetic pickup of claim 7, wherein the first pole pieces in the first core regions (7, 8; 12, 13) are surrounded by 1000-5000 turns of coil wire, and the said second pole pieces of the second core region are surrounded by 6000-12000 turns of coil wire.

9. An electromagnetic pickup of claim 8 wherein the pole pieces in the core regions (4-8, 9-13) of coils (2, 3) are permanent magnets.

10. An electromagnetic pickup of claim 7, wherein the first pole pieces in the first core region (7; 12) are surrounded by 1000-3000 turns of coil wire, and the said second pole pieces of the said second core region (4-6; 9-11) are surrounded by 7000-11 000 turns of coil wire.

11. An electromagnetic pickup of claim 10 wherein the pole pieces in the core regions (4-8, 9-13) of coils (2, 3) are permanent magnets.

12. An electromagnetic pickup of claim 7 wherein the pole pieces in the core regions (4-8, 9-13) of coils (2, 3) are permanent magnets.

13. An electromagnetic pickup of claim 12 wherein the core regions (4-6; 9-11) consist of three permanent magnets set in line, the distance between each of the three magnets in the said line being equal.

14. An electromagnetic pickup of claim 1, wherein the longitudinal axis (Z-Z) of coils (2, 3) is set in an angle •=5-20 degrees as compared to the longitudinal axis of the pickup.

15. An electromagnetic pickup of claim 1, wherein the overall width (W) of the pickup is 20 mm or less and the length (S) of the pickup is 80 mm or less.

16. An electric guitar having a pickup with a first longitudinal coil (2, 2') having a first end (15, 15') and a second end (16, 16'), and a second longitudinal coil (3, 3') having a first end (17, 17') and a second end (18, 18'), where both coils (2, 3, 2', 3') have pole pieces (4-8 and 9-13, 48 and 913) in their core region made of magnetically permeable material, and the said first pole pieces (4-8, 48') of the said first core region have an opposite magnetic polarity compared to the said second pole pieces (9-13; 913) in the said second core region, and a connection that connects the two coils (2, 2', 3, 3') to one another out of phase either in parallel or in series, so that they cancel each other's extraneous noise and hum, characterized by the area (14) where the coils (2, 3, 2', 3') are partly overlapping each other and the first pole pieces (4-8, 48) in the core region of the first coil (2, 2') are partly overlapping the pole pieces (9-13, 913') in the core region of the second coil (3, 3'), and by that in the overlapping area (14), the coils (2, 3, 2', 3') with the pole pieces (4-13, 48', 913') in their core regions induce a voltage of the same level that is induced by the coils (2, 3, 2', 3') with the pole pieces (4-13, 48', 913') in their core regions outside the overlapping area (14).

17. An electric guitar of claim 16, wherein the number of turns of the coil is smaller in the first end (15) of the first coil (2) in the overlapping area (14) than the number of turns of the coil in the second end (19) of the first coil (2) outside the overlapping area (14), wherein the number of turns of the coil is smaller in the first end (17) of the second coil (3) in the overlapping area (14) than the number of turns of the coil in the second end (20) of the second coil (3) outside the overlapping area (14), and wherein the number of turns of the coil in the first coil (2) in the overlapping area (14) is the same, or in the same region, as the number of turns of the coil in the second coil (3) in the overlapping area (14).

18. An electric guitar of claim 17, wherein both coils (2; 3) have a first core region (7; 12) placed in the overlapping area (14) and a second core region (4-6; 9-11) placed outside the overlapping area (14), and the said first core regions (7; 12) are both surrounded by 1000-5000 turns of coil wire, and the said second core regions (4-6; 9-11) are both surrounded by 6000-12000 turns of coil wire.

19. An electric guitar of claim 16, wherein both coils (2; 3) have a first core region (7; 12) placed in the overlapping area (14) and a second core region (4-6; 9-11) placed outside the overlapping area (14), and the said first core regions (7; 12) are both surrounded by 1000-5000 turns of coil wire, and the said second core regions (4-6; 9-11) are both surrounded by 6000-12000 turns of coil wire.

* * * * *